United States Patent [19]

Whitted

[11] 4,083,221

[45] Apr. 11, 1978

[54] PARTS FORMING APPARATUS AND METHOD

[75] Inventor: Robert Lee Whitted, Muncie, Ind.

[73] Assignee: Duffy Tool & Stamping, Inc., Muncie, Ind.

[21] Appl. No.: 709,761

[22] Filed: Jul. 29, 1976

[51] Int. Cl.[2] ..... B21D 53/10

[52] U.S. Cl. ..... 72/405; 72/370

[58] Field of Search ..... 72/370, 381, 391, 399, 72/403, 404, 405

[56] References Cited

U.S. PATENT DOCUMENTS

| | | | |
|---|---|---|---|
| 1,850,679 | 3/1932 | Leis | 72/405 |
| 1,942,666 | 1/1934 | Schwartz | 72/404 |
| 1,964,584 | 6/1934 | Klocke | 72/404 |
| 1,978,685 | 10/1934 | Mogford et al. | 72/414 |
| 2,266,997 | 12/1941 | Sherman | 72/403 |
| 3,590,622 | 7/1971 | Elge et al. | 72/370 |
| 3,591,919 | 7/1971 | Cavagnero et al. | 29/564 |
| 3,969,918 | 7/1976 | Bernotus | 72/405 |

*Primary Examiner*—Michael J. Keenan

*Attorney, Agent, or Firm*—Jenkins, Coffey & Hyland

[57] ABSTRACT

A method of forming a generally cylindrical part from a generally flat, rectangular metal blank in a punch press constitutes the steps of primarily forming the blank by bending two opposite longitudinal edge portions of the blank to predetermined configurations with respect to the remainder of the blank in a first die section. The primarily formed blank is transferred to a second die section wherein it is secondarily formed downwardly over a mandrel having an axis parallel to the two longitudinal edge portions. In the secondarily formed blank, the two longitudinal edge portions are thus turned inwardly toward each other. The secondarily formed blank has a generally oval or U-shaped transverse section. The secondarily formed blank is then transferred to a third die section wherein the part is formed by curling the blank so that the two longitudinal edges are adjacent one another. The apparatus of the present invention is adapted for use in a punch press which has a pair of spaced-apart die shoes and means for moving one of the die shoes toward and away from the other during each press stroke. The apparatus includes a first die section for primarily forming the blank, a second die section for secondarily forming the primarily formed blank, and a third die section for curl-forming the secondarily formed blank. A punch press feed is provided adjacent the first die section for transferring successive primarily formed blanks to the second die section. Each successive primarily formed blank transfers a preceding secondarily formed blank into the third die section to be finish formed.

8 Claims, 8 Drawing Figures

PARTS FORMING APPARATUS AND METHOD

This invention relates to methods and apparatus for forming parts in a punch press. The disclosed method and apparatus are particularly useful for forming cylindrical or at least generally cylindrical parts. The invention is disclosed in the context of apparatus and a method for manufacturing bushings and tubes of varying lengths, diameters and finished tolerances. The method and apparatus disclosed are adaptable to provide all conventional metal stamping operation, e.g., piercing, lancing, piloting, and profiling. Such conventional operations are performed by the method and apparatus of the instant invention as the forming process progresses.

There are several known types of presses for forming bushings and tubes of varying diameters and lengths. There is, for example, the U.S. Baird MULTISLIDE MACHINE. Typically, such devices form bushings and tubes about a vertically extending mandrel in a plurality of successive forming operations. The forming and finished tolerances are controlled by a plurality of forming dies and the mandrel. The dies are controlled by a plurality of cams which move the dies in forming strokes about the mandrel to form the bushing or tube. Typically, the size of such devices increases radically with the size of the parts to be formed. Therefore, the length of the part to be formed is limited.

It is an object of the present invention to provide novel apparatus and method for forming such parts. The apparatus of the present invention can remain relatively compact for parts having considerable length.

A further object of the present invention is to provide an apparatus and method which are adaptable to form such parts in a standard punch press. The present invention thereby circumvents the need for highly specialized, large and expensive forming machines.

A further object of the present invention is to provide such a method and apparatus which are adaptable to perform certain conventional metal stamping operations as adjuncts to the tube forming process.

According to the method of the present invention, a generally cylindrical part is formed from a generally rectangular stock blank in a punch press. The method includes the steps of primarily forming the blank by bending two longitudinally extending edge portions of the blank to predetermined configurations with respect to the remainder of the blank in a first die section. The primarily formed blank is then transferred to a second die section, where the blank is secondarily formed about an axis parallel to the two longitudinal edge portions, with the longitudinal edge portions turned inwardly at opposite edges of the secondarily formed blank. The secondarily formed blank is then transferred to a third die section, wherein the blank is finish- or curl-formed into the desired part. In the third die section, the secondarily formed blank is curled so that the two longitudinal edges are adjacent one another.

Further, according to an embodiment of the method, the third die section includes a floating mandrel for controlling an internal dimension of the finished part, the secondarily formed part being transferred onto the floating mandrel as it is transferred to the third die section. When the inside diameter of the finished part does not need to be controlled, the floating mandrel is not required.

Additionally, according to the method of the invention, the blank is obtained by scoring a length of coil stock as the punch press upon which the inventive apparatus is mounted executes a forming stroke upon a preceding blank. The score is made a distance from the free end of the strip stock, the distance being substantially equal to a dimension of the blank, e.g., the width of the blank. The scored free end of the strip stock is then broken from the stock along the score line to create the blank.

Importantly, according to the method of the present invention, the coil stock can be stamped, pierced, lanced, embossed, and/or piloted in an auxiliary die set as adjuncts to the forming operation in the punch press, as forming of a preceding blank is occurring.

Further, according to the present invention, apparatus is provided for use with a punch press having a pair of spaced-apart surfaces and means for moving one of the surfaces toward and away from the other during each stroke of the press. The apparatus comprises a plurality of forming die sections adapted for mounting on the spaced-apart surfaces. The apparatus forms a generally cylindrical part from a flat, generally rectangular metal blank. Such apparatus includes a first die section for primarily forming the blank by bending two lateral edge portions thereof to a predetermined configuration with respect to the remaining portion of the blank. At least one die block of the first section is mounted from each of the punch press surfaces. A second die section secondarily forms the primarily formed blank, the secondarily formed blank having a generally oval or U-shaped transferse section with the two lateral edges in spaced-apart relation adjacent one another providing a longitudinal slot in the secondarily formed blank. At least one die block of the second set is mounted on each of the punch press surfaces. The apparatus further includes a third die section for finish-or curl-forming the part from the secondarily formed blank. At least one die block of the third section is mounted on each of the punch press surfaces.

Further, according to the apparatus of the present invention, a floating mandrel is provided for controlling an interior dimension of the part during finish-forming. The mandrel includes an outer mandrel surface sized to control such dimension and means for supporting the mandrel between the dies of the third section to permit the secondarily formed blank to be transferred from the second die section to a position in engagement with the mandrel prior to finish forming. In the illustrated embodiment, the mandrel has a bore extending therethrough parallel with the mandrel axis, and the mandrel support means includes a flexible cable which extends through the bore. The flexible cable is pretensioned and has first and second ends, which ends are provided with cable snubbers. At least one of the ends is spring-loaded to absorb shock during finish forming by the third die section. The mandrel thereby is supported by the cable, the snubbers and the spring from selected ones of the die sections.

Additionally, according to the present invention, an auxiliary die set is supported between the surfaces. The auxiliary die set includes apparatus for performing one or more of a plurality of conventional metal stamping operations on the coil stock from which the blanks are being created during one or more successive strokes of the punch press. During such successive strokes, one or more preceding blanks can be formed in the first, second and third die sections. Illustratively, the auxiliary die set includes one or more of the following combinations of apparatus: a profiling punch and die block for profiling, e.g., serrating, at least one edge of the stock from which the blank is to be formed; a scoring punch and anvil for scoring at least one surface of the stock; and, a pilot punch for piercing a pilot hole in the strip stock.

Additional objects and features of the present invention will become apparent to those skilled in the art to which this invention pertains by referring to the following description and accompanying drawings which illustrate the invention. In such drawings:

FIG. 1*a* is a top plan view of a lower die shoe assembly for a punch press, which assembly includes an auxiliary die used to execute one or more conventional metal stamping operations, and a lower subassembly plate upon which are mounted die sections for performing forming operations on a generally flat, rectangular metal blank;

FIG. 1*b* is an inverted plan view of the upper die shoe assembly corresponding to the lower shoe assembly illustrated in FIG. 1*a;*

FIG. 6 is a fragmentary sectional view of the apparatus of FIGS. 1*a–b,* taken generally along section lines 6—6 of FIG. 1*a.

A conventional punch press includes a pair of surfaces which are spaced apart, at least one of the surfaces being reciprocable toward and away from the other during each stroke of the press. It is understood that the apparatus herein described is adapted for use with such a press between its said surfaces.

Figure 1A:
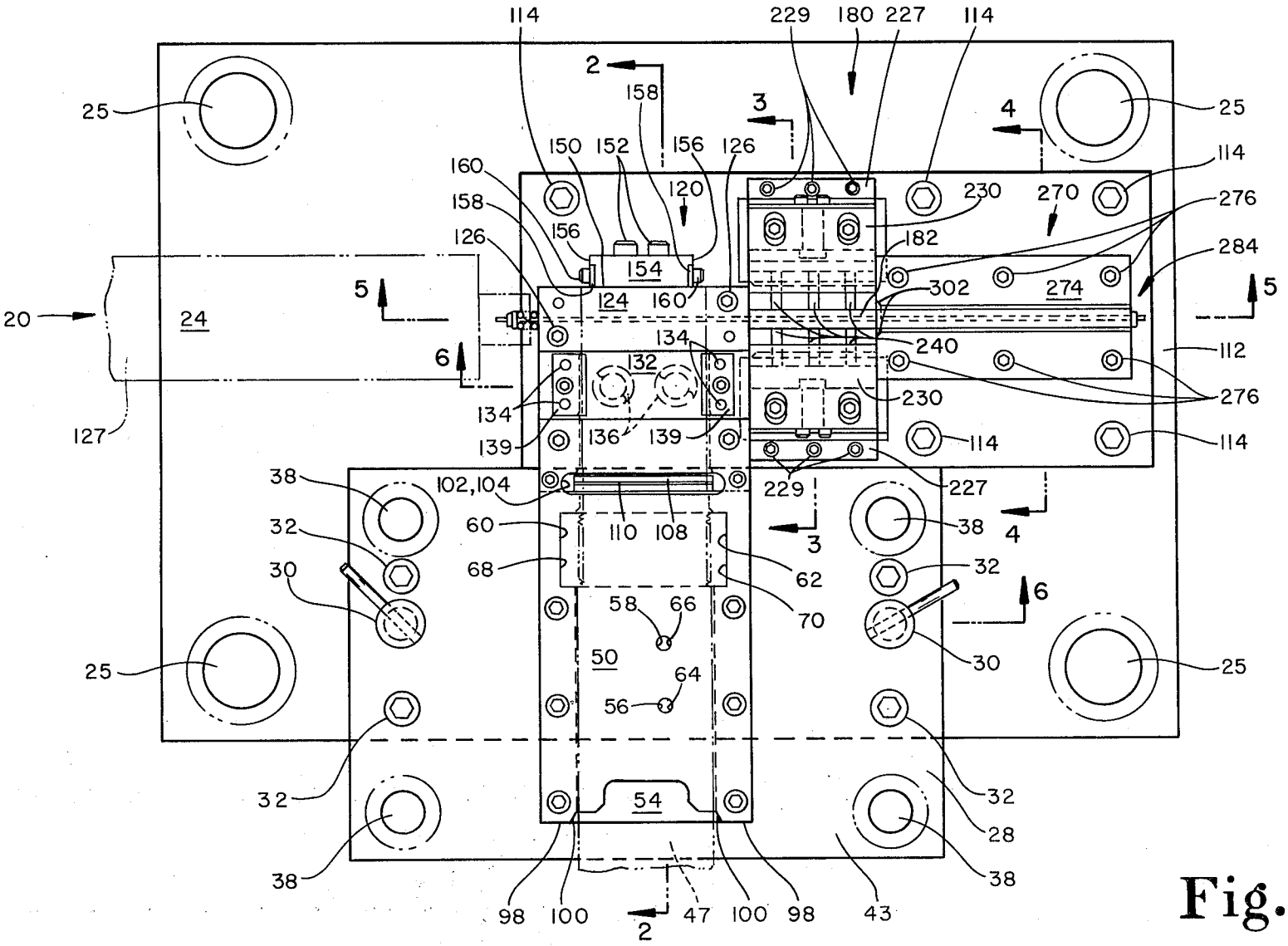
Figure 1B:
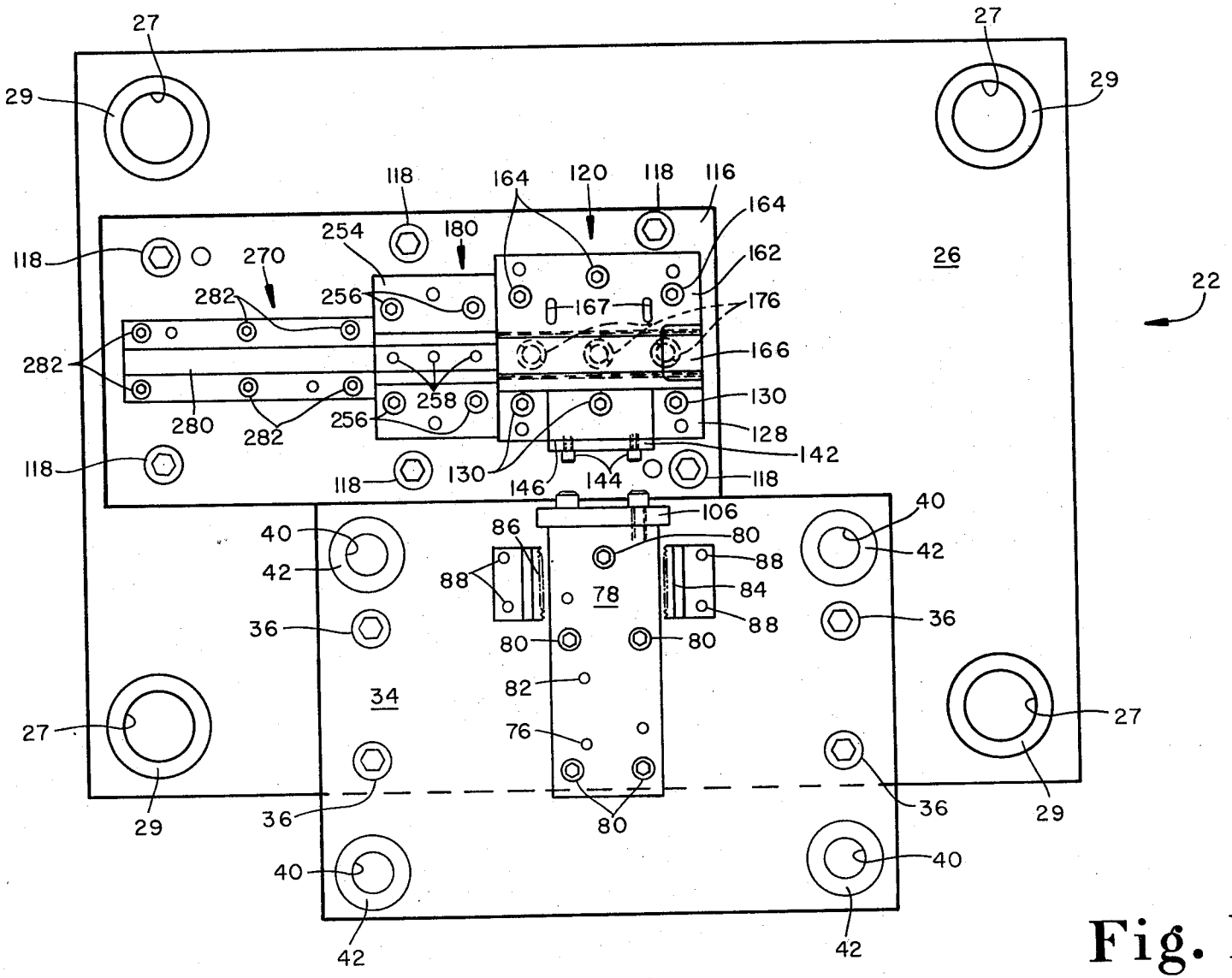

FIGS. 1*a–b* are plan views of the lower die shoe 20 and upper die shoe 22, respectively, for mounting on the press. It is upon the surfaces 24, 26, respectively, of these shoes that dies are conventionally mounted for performing various stamping and forming operations to be conducted in the press. A set of die shoe guide posts 25 mounted on shoe 20 extend upwardly and engage a plurality of holes 27 in upper shoe 22. Typically, holes 27 are provided in guide post bushings 29. Posts 25 guide the reciprocation of upper shoe 22 relative to lower shoe 20.

A lower auxiliary die shoe 28 is located upon shoe 20 by a pair of locating pins 30. Shoe 28 is attached to shoe 20 by a plurality of bolts 32. An upper auxiliary die shoe 34 is mounted upon shoe 22 by bolts 36. A set of guide posts 38 extend upwardly from lower auxiliary die shoe 28 and engage a plurality of holes 40 in upper auxiliary die block 34. Typically, holes 40 are provided in guide bushings 42. Posts 38 aid in guiding the reciprocation of upper die shoe 34 on lower die shoe 28.

Figure 6:
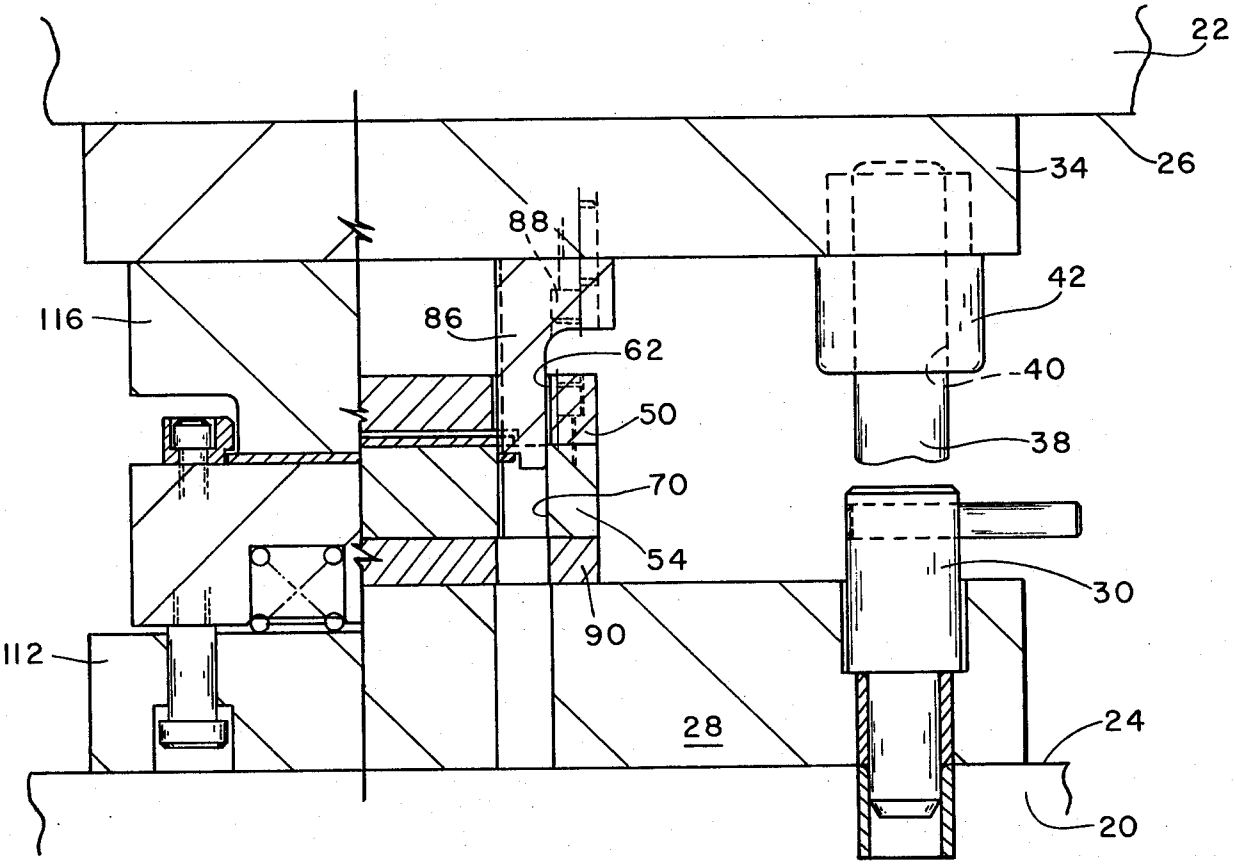

Mounted at approximately the center of the front edge 43 of shoe 28 is an initial punch press feed 46. See FIG. 2. Initial feed 46 feeds flat stock 47 from a source, e.g., a coil of flat stock, between the bottom surface 48 of a stripper 50 and a top surface 52 of a die block 54. Desirably, initial feed 46 is of an air-operated type, e.g., the RAPIDAIR GROUP I, MODEL D-3 feed. See FIG. 2. Stripper 50 has a plurality of openings 56, 58, 60, 62, therein which register with an equal plurality of openings 64, 66, 68, 70 in die block 54. Openings 64, 66 are equipped with bushings 72, 74, respectively. Openings 56, 64 in stripper 50 and die block 54, respectively, correspond in location to a pierce punch 76 located in a punch pad 78 which is attached to upper auxiliary die shoe 34 by a plurality of bolts and dowels 80. Openings 58, 66 correspond in location to a pilot punch 82 on punch pad 78. Openings 60, 62, 68, 70 correspond in location to a pair of profile punches 84, 86, which are attached by bolts and dowels 88 to shoe 34. In the illustrated embodiment, the die block 54 is spaced apart from shoe 28 by a back-up plate 90. See also FIG. 6.

It is to be understood that auxiliary die shoes 28, 34 can incorporate apparatus in addition to, or instead of, pierce punch 76, pilot 82, and profile punches 84, 86 to incorporate into the auxiliary die set any desired combination of conventional metal stamping operations, e.g., piercing, piloting, lancing, embossing, and profiling. In short, auxiliary die shoes 28, 34 can produce in the coil stock 47 being fed to the forming apparatus of the present invention any desired combination of hole patterns, embossing, and edge formation. It is to be noted that in the illustrated embodiment, profile punches 84, 86 and openings 60, 62, 68, 70 produce serrations along both edges of the strip stock 47 being fed toward the rear of the die set (toward the tops of FIGS. 1*a–b*). Either or both edges of the strip stock can be profiled in any desired pattern. Of course, the coil stock need not be profiled at all. The leading edge 98 of stripper 50 is bevelled as at 100 (FIG. 1*a*) to assist in threading the coil stock between surfaces 48, 52, respectively, of the stripper and die block.

Rearwardly from openings 60, 62, 68, 70, stripper 50 and die block 54 are provided with openings 102, 104, respectively. Openings 102, 104 extend generally transversely of the first direction of initial feed of sheet stock through the auxiliary die shoe 28. Opening 102 accommodates a score anvil 106 which is oriented such that, as upper die shoe 22 reaches the bottom of its stroke, score anvil 106 extends through opening 102 and contacts the upwardly facing surface of the strip stock. Opening 104 accommodates a score punch 108 which includes a score knife 110. Score knife 110 is presented upwardly toward the downwardly facing surface of the coil stock 47 as the stock passes through die shoe 28. Score knife 110 tapers from a broad base where it joins score punch 108 to an edge at its upward extent.

As can be appreciated from the illustrated embodiment, a number of different auxiliary die shoes 28, 34 can be maintained by a manufacturer, each set of die shoes 28, 34 including one of a number of different patterns for coil stock for the parts which the manufacturer is called upon to make. Auxiliary die shoes 28, 34 are interchangeable on shoes 20, 22 independently of any other attachments to shoes 20, 22.

Attached to lower shoe 20 rearwardly from auxiliary die 28 (upwardly from die 28 in FIG. 1*a*) is a lower subassembly plate 112. Lower subassembly plate 112 is attached to shoe 20 by a plurality of bolts and dowels 114. An upper subassembly plate 116 is attached in a corresponding location to upper die shoe 22 by a plurality of bolts and dowels 118. See FIG. 1*b*.

A first die section 120 comprises a primary forming block 124 attached to lower subassembly plate 112 by bolts and dowels 126. First die section 120 further comprises a primary forming and cut-off punch 128, which is attached to upper subassembly plate 116 by a plurality of bolts and dowels 130.

A secondary punch press feed 127 including a feed finger 129 (see FIG. 5) is attached to lower die shoe 20 adjacent first die section 120. Feed 127 desirably is an air-operated punch press feed such as, for example, the RAPIDAIR GROUP I MODEL C-12 feed with electric actuating valve (not shown).

Figure 2:
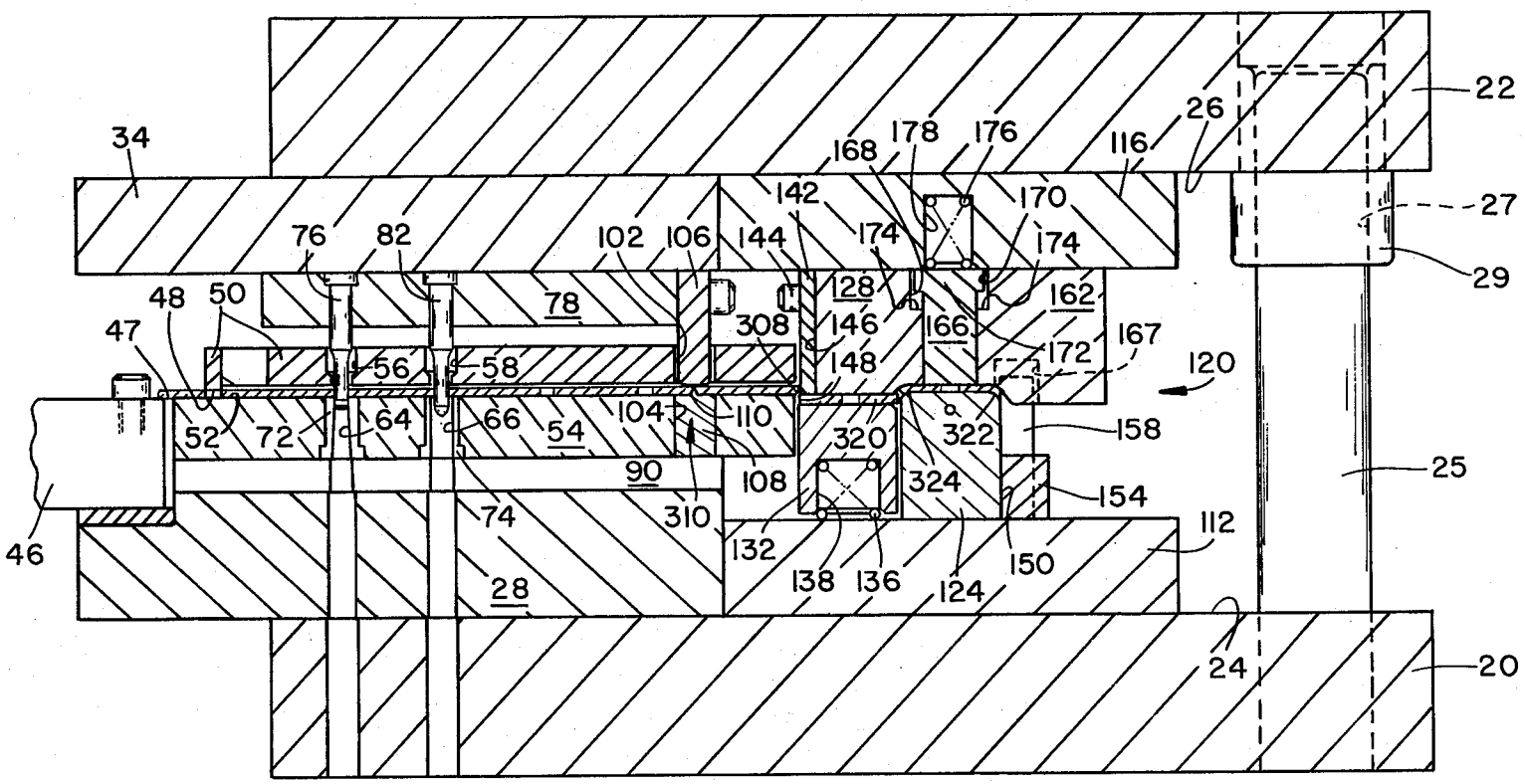
FIG. 2 is a fragmentary sectional view of the apparatus of FIGS. 1*a–b,* taken generally along section lines 2—2 of FIG. 1*a;*

Referring again to first die section 120, as best illustrated in FIG. 2, a cut-off cushion 132 located on shoulder screws 134 (FIGS. 1*a* and 6) is urged upwardly from lower subassembly plate 112 in front of and adjacent primary forming block 124. Cushion 132 is urged upwardly from plate 112 by springs 136 which are captured in recesses 138 on the underside of cushion 132. A pair of stock guides 139 are mounted on the upwardly facing surface of cushion 132 to guide coil stock 47 therethrough.

A cut-off blade 142 is attached by a plurality of bolts 144 to the front face 146 of primary forming and cut-off punch 128. Blade 142 presents an edge 148 transversely of the path of the coil stock moving rearwardly (toward the right in FIG. 2) from between stripper 50 and die block 54.

Mounted at the rearward face 150 of primary forming block 124 by bolts 152 is a stop retainer 154. At each end 156 of stop retainer 154 is a stop guide 158. Stop guides 158 are positioned on stop retainer 154 by bolts 160.

First die section 120 further includes a primary forming punch 162, which is attached to upper subassembly plate 116 by a plurality of bolts and dowels 164. Elongated recesses 167 are provided in punch 162 to accommodate stop guides 158. Die section 120 also includes an upper cushion 166 which is captured between two facing surfaces 168, 170 of punches 128, 162. The enlarged upper portion 172 of cushion 166 is urged downwardly against shoulders 174 of punches 128, 162 by a plurality of springs 176 which are captured in recesses 178 in upper subassembly plate 116.

Figure 3:
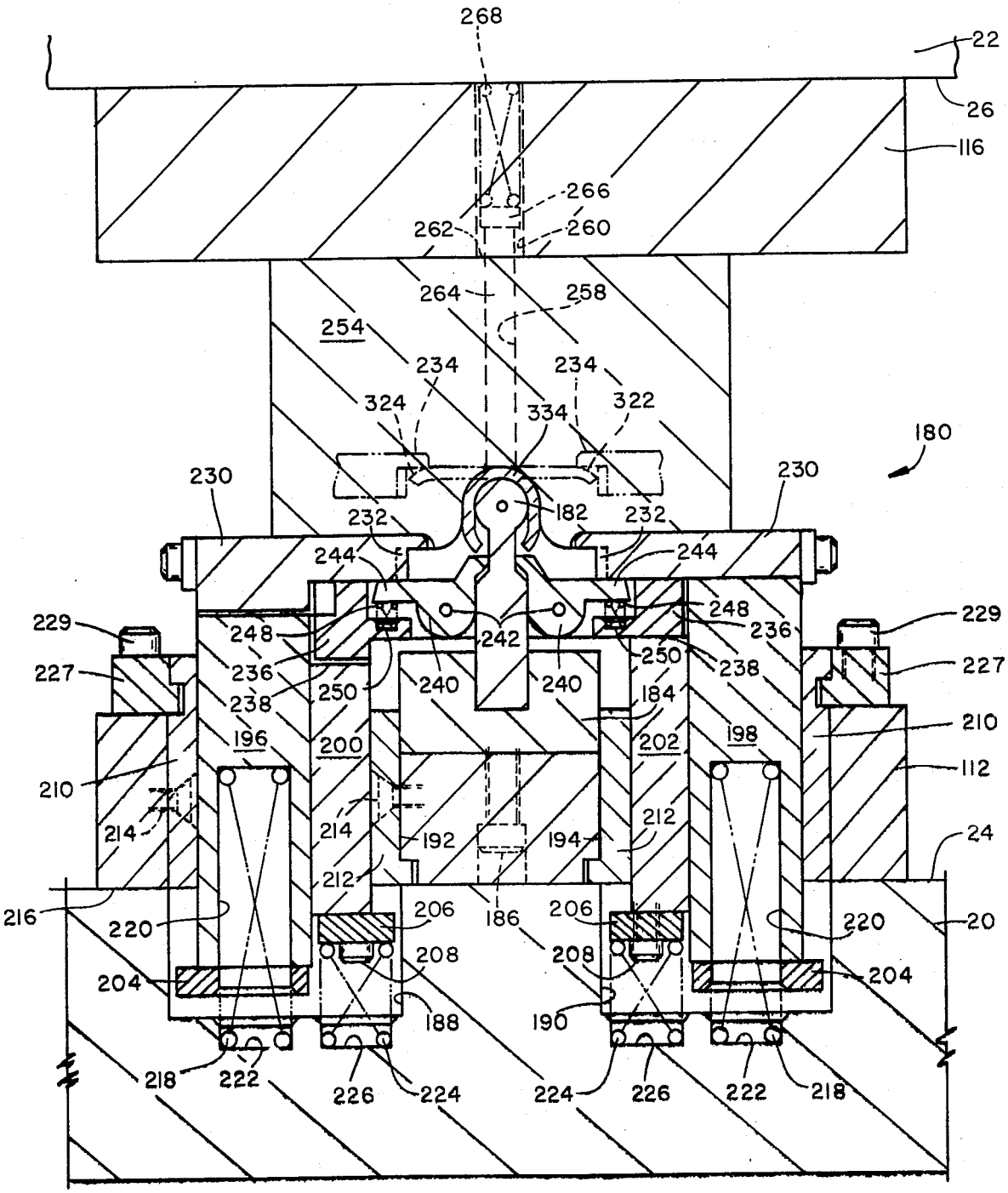
FIG. 3 is a fragmentary sectional view of the apparatus of FIGS. 1*a–b,* taken generally along section lines 3—3 of FIG. 1*a;*

As best illustrated in FIG. 3, a second die section 180 comprises a mandrel 182, which rests in a mandrel nest 184. The mandrel and nest are attached to lower subassembly plate 112 by a plurality of bolts and dowels 186. The lower die shoe 20 includes a pair of recesses 188, 190 which flank mandrel nest 184. Recess 188 is in front of the mandrel nest (to the left in FIG. 3), and recess 190 is behind the mandrel nest (to the right in FIG. 3). A pair of openings 192, 194 in lower subassembly plate 112 correspond approximately in shape to recesses 188, 190, respectively. Two outer stripper slides 196, 198 are disposed in recesses 188, 190, respectively, and protrude through openings 192, 194, respectively. Similarly, two inner stripper slides 200, 202 are disposed in recesses 188, 190, respectively, and protrude through openings 192, 194 adjacent mandrel nest 184. Stripper slides 196, 198, 200, 202 are captured in their respective recesses 188, 190 by outer slide retainers 204 which are attached to the bottom faces of outer stripper slides 196, 198 and by inner slide retainers 206 which are attached by bolts 208 to the under surfaces of inner stripper slides 200, 202. Retainers 204, 206 are aided by a set of outer guides 210 and a set of inner guides 212. Guides 210, 212 are attached to the facing surfaces of openings 192, 194 by a plurality of countersunk bolts 214, two of which are illustrated in broken lines in FIG. 3.

The outer and inner stripper slides 196–202 all slide freely and independently of one another within their respective guides 210, 212. Outer stripper slides 196, 198 are urged upwardly toward the bottom surface 216 of lower subassembly plate 112 by springs 218 which are captured within recesses 220 on the undersides of slides 196, 198 and within depressions 222 in recesses 188, 190. Inner stripper slides 200, 202 are urged upwardly toward bottom surface 216 by springs 224 which are positioned about the heads of bolts 208 and are retained in depressions 226 in recesses 188, 190, respectively. The slides 196, 198, 200, 202 and guides 210, 212 are all held in place between the mandrel nest 184 and a pair of guide retainers 227 which are attached to lower subassembly plate 112 by a plurality of bolts 229.

Attached to the upwardly facing surfaces 228 of outer stripper slides 196, 198 are a pair of stripper guides 230. Each of stripper guides 230 is generally flat and horizontally oriented. The facing edges of stripper guides 230 are undercut as indicated at 232 to engage and begin secondary forming of primarily formed blanks (as indicated in broken lines at 234 in FIG. 3) as will be explained subsequently.

A pair of stripper finger holders 236 are supported upon the upwardly facing surfaces 238 of inner stripper slides 200, 202. A set of stripper fingers 240 is pivotally mounted upon dowels 242 from each stripper finger holder 236. Illustratively, each of holders 236 is equipped with three stripper fingers 240. Each stripper finger 240 includes a portion 244 which projects toward its holder 236. An oppositely directed portion 236 of each of stripper fingers 240 is urged downwardly by a spring 248 which is captured between each of portions 244 and one of a plurality of recesses 250 provided in stripper finger holders 236.

Second die section 180 further includes a secondary forming punch 254 mounted by a plurality of bolts and dowels 256 from upper subassembly plate 116. Punch 254 includes a plurality of openings 258 which register with an equal plurality of openings 260 in upper subassembly plate 116. Openings 260 are slightly larger in diameter than openings 258, and a shoulder 262 is thus provided at the intersection of openings 258, 260. A plurality of stripper pins 264 with heads 266 are captured in openings 260 by shoulders 262. Head 266 of each pin 264 is urged downwardly against its respective shoulder 262 by a spring 268 retained in opening 260 by head 266 and upper die shoe 22.

Figure 4:
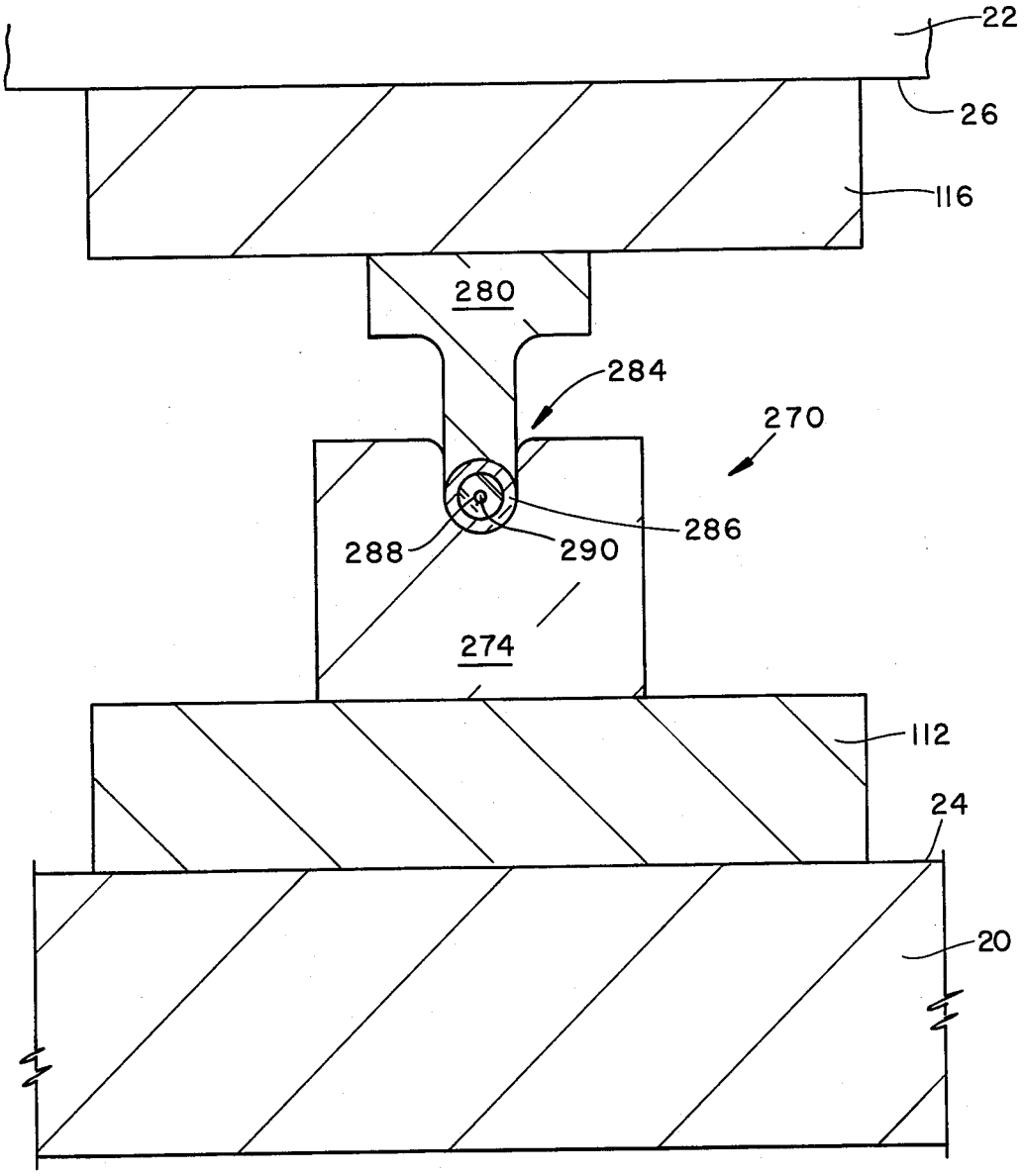
FIG. 4 is a fragmentary sectional view of the apparatus of FIGS. 1*a–b,* taken generally along section lines 4—4 of FIG. 1*a;*

A third die section 270 is best illustrated in FIG. 4. Die section 270 includes a lower curling- or finishing-block 274 which is attached to lower subassembly plate 112 by a plurality of bolts and dowels 276 (see FIG. 1*a*). Die section 270 further includes a curling- or finish-punch 280 which is attached to upper subassembly plate 116 by bolts and dowels 282. Die section 270 also includes a floating mandrel 284.

Figure 5:
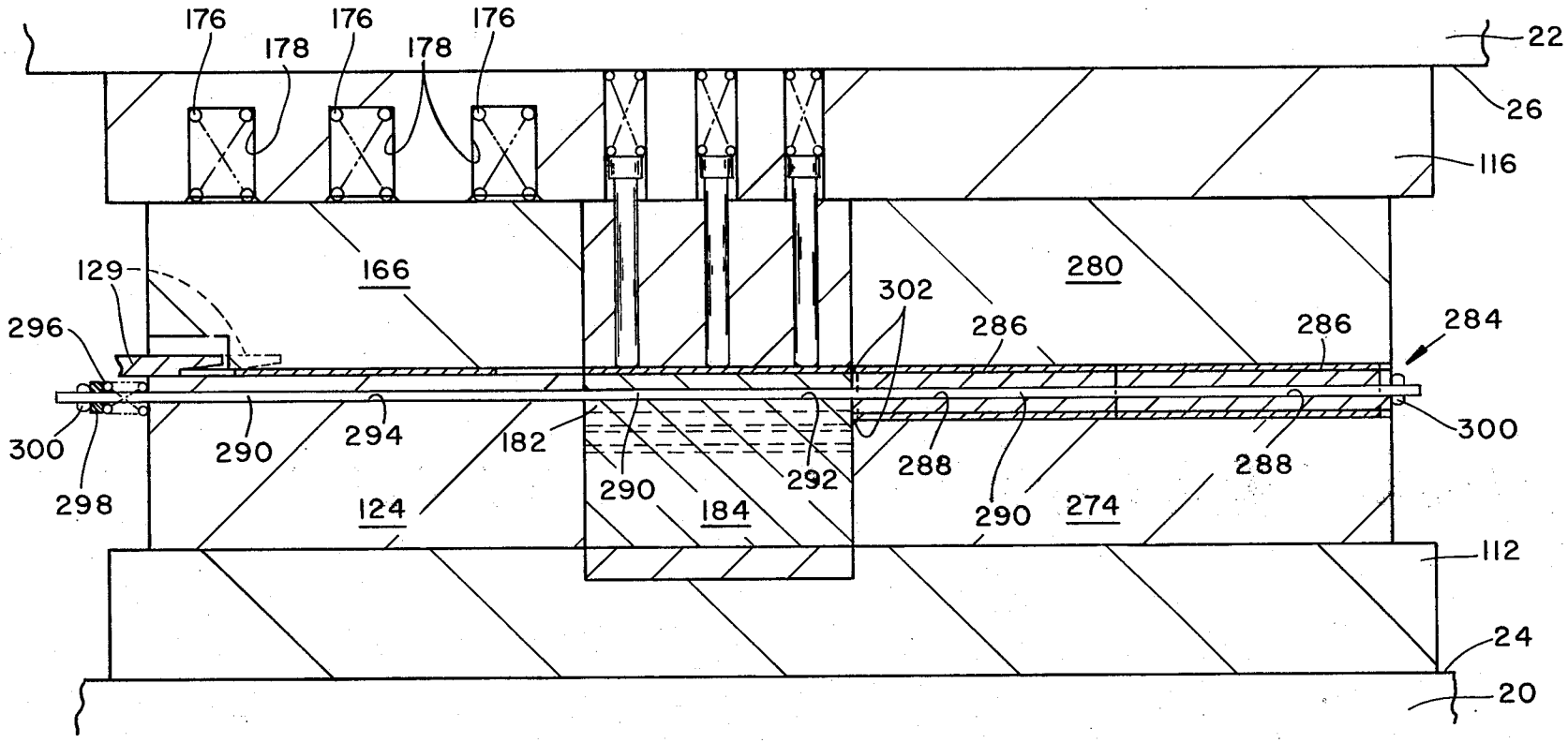
FIG. 5 is a fragmentary sectional view of the apparatus of FIGS. 1*a–b,* taken generally along section lines 5—5 of FIG. 1*a;*

As best illustrated in FIG. 5, mandrel 284 has an outer control surface 286 and an axially extending bore 288. A stranded flexible cable 290 is threaded through bore 288 and through coaxial bores 292, 294 in mandrel 182 and primary forming block 124, respectively. A shock absorbing spring 296 and a retaining washer 298 are placed upon one end of cable 290. Finally, cable snubbers 300 are placed on the ends of cable 290 while the cable is under tension. Floating mandrel 284 is thereby positioned in the third die section 270. As can best be seen in FIGS. 1*a* and 5, lower curl-block 274 includes a bevelled surface 302 for guiding secondarily formed parts into the third die section 270 around floating mandrel 284, as will be explained subsequently.

Figure 7:
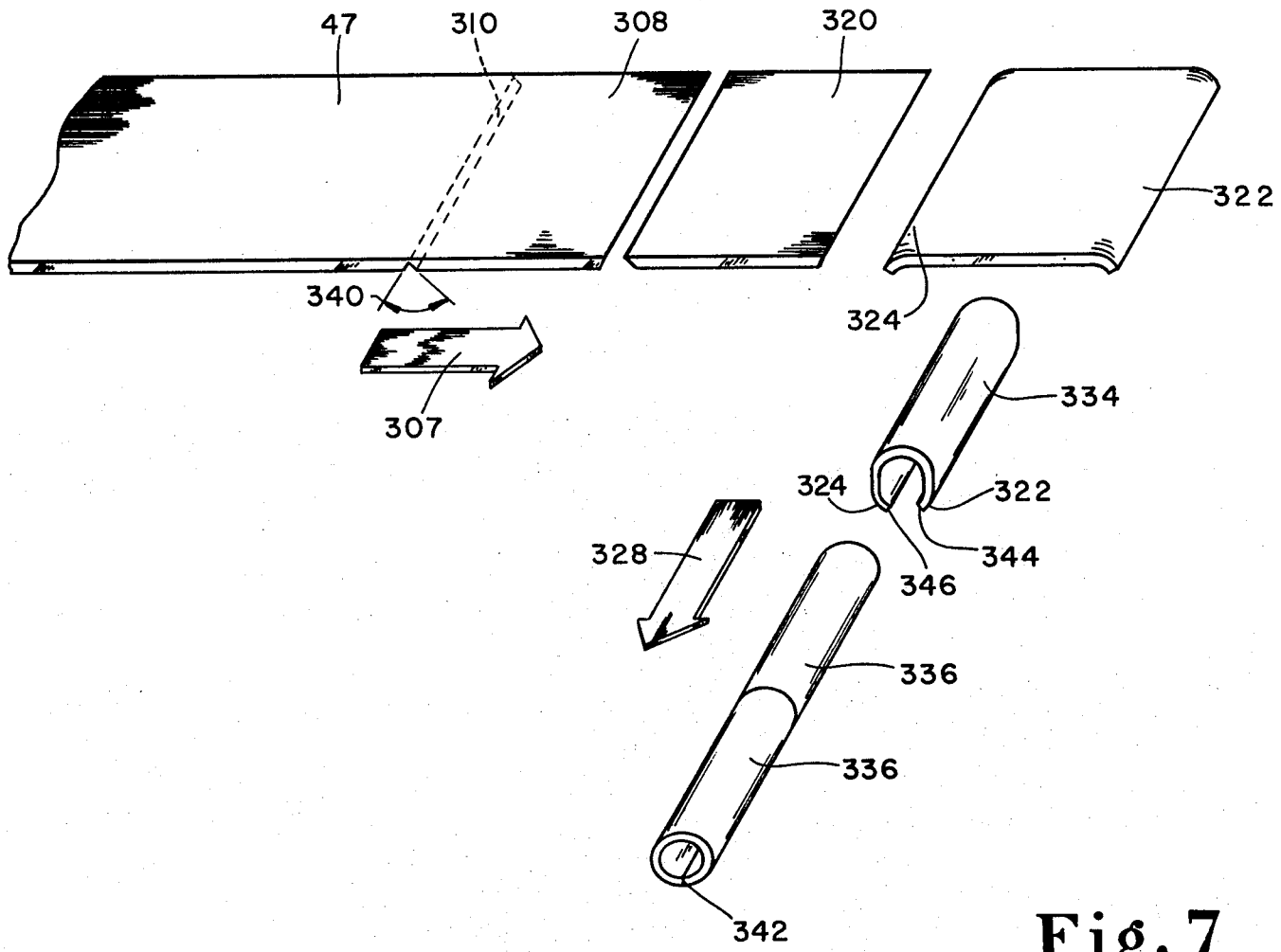
* and FIG. 7 is a diagrammatic perspective view of material flow in accordance with the method and the apparatus of the present invention.

To explain the operation of the forming apparatus, reference will first be made to FIGS. 2 and 7. As is illustrated in FIG. 2, the coil stock 47 is supplied from initial feed 46 between stripper 50 and die block 52. During successive strokes of the punch press, all necessary stamping operations incorporated into auxiliary die shoes 28, 34 are performed. Illustratively and as previously mentioned, the auxiliary die set includes a pierce punch 76 and bushing 72, a pilot 82 and bushing 74, and profile punches 84, 86 which cooperate with openings 60, 62, 68, 70 to profile in any desired fashion the transverse edges 85, 87 of strip stock 47 as the stock 47 is fed in a first direction (the direction of arrow 307 in FIG. 7 and from left to right in FIG. 2) through the auxiliary die shoes 28, 34.

After a predetermined number of feeds the free end 308 of coil stock 47 passes between score anvil 106 and score punch 108. As the punch press reaches the bottom of the next successive stroke, coil stock 47 is scored as illustrated at 310 along a line generally transverse to the first direction, indicated by arrow 307 (FIG. 7). During the next succeeding stroke of the press, strip stock 47 passes between cut-off cushion 132 and cut-off blade 142. Initial feed 46 stops the stock when the score line 310 is positioned between cut-off cushion 132 and cut-off blade 142. During the next successive stroke of the punch press, the cushion and blade separate a blank 320 between the free end and the score line from stock 47. As upper die shoe 22 is raised following formation of the blank 320, springs 136 urge cushion 132 upwardly to present blank 320 at the same vertical height as the new free end of strip stock 47 and the upwardly facing surface of primary forming block 124.

Feed 46 then forces the new free end in the first direction. Blank 320 is pushed into position against stops 158. As the punch press reaches the bottom of its next successive stroke, the leading- and trailing-edge portions 322, 324, respectively, of blank 320 are primarily formed downwardly to a predetermined configuration between primary forming block 124 on the bottom and primary forming and cut-off punch 128, primary forming punch 162 and upper cushion 166 on the top. For tubes having circular cross sections, this configuration typically includes radially forming these leading- and trailing- edge portions.

As the forming operation proceeds, the direction of motion of the now primarily formed blank 326 changes. During successive operations, the blank will move in a second direction (generally out of the page in FIG. 2) illustrated by arrow 328 in FIG. 7. Motion in this second direction will be controlled by punch press feed 127. See FIGS. 1*a*and 5.

As upper die shoe 22 is raised following the primary forming step, feed finger 129 of feed 127 engages the rearward edge of primarily formed blank 326. Blank 326 moves forward in second direction 328 (FIG. 7) to a position within second die section 180. As illustrated in broken lines in FIG. 3, primarily formed blank 326 rests upon mandrel 182 with its leading- and trailing-edge portions 322, 324, respectively, engaged beneath the undercut portions 232 of stripper guides 230. During the next successive stroke of the punch press, as secondary forming punch 254 moves toward the downward extent of its stroke, the punch carries with it stripper guides 230. It is to be recalled that guides 230 are mounted upon outer stripper slides 196, 198 and are thereby urged upwardly against the under surface of secondary forming punch 254 by springs 218. The stripper guides release the primarily formed blank 326 downwardly about mandrel 182. As guides 230 are forced downwardly, edge portions 322, 324 move out of engagement with such guides. The secondary forming operation in die section 180 is completed by the downwardly facing surfaces of secondary forming punch 254. The secondarily formed blank 334, illustrated in solid lines in FIGS. 3 and 7, results. Die shoe 22 moves upwardly after reaching the bottom of the secondary forming stroke. Outer stripper slides 196, 198 and inner stripper slides 200, 202 are thereby allowed to move vertically upwardly. Outer stripper slides 196, 198 move upwardly to a position dictated by outer slide retainers 204 and outer guides 210, placing stripper guides 230 in a position to receive the next primarily formed blank. See again the broken-line illustration in FIG. 3. Inner stripper slides 200, 202 move upwardly to a position dictated by inner slide retainers 206 and inner guides 212.

As inner stripper slides 200, 202 move upwardly, they carry with them the stripper finger holders 236 and stripper fingers 240. The stripper fingers 240 engage edge portions 322, 324 of the secondarily formed blank 334 and move blank 334 upwardly to a position at which it will be engaged at approximately the center of its vertical height by the next primarily formed blank to be pushed by feed 127 into the second die section 180.

As the next successive blank is pushed into second die section 180, secondarily formed blank 334 is engaged and pushed thereby into third die section 270. Since the floating mandrel 284 of die section 270 is suspended upon cable 290, floating mandrel 284 is concentric with mandrel 182 of second die section 180. Thus, as the secondarily formed blank 334 moves into the third die section 270, blank 334 engages floating mandrel 284.

During the next successive stroke of the punch press, secondarily formed blank 334 is curl- or finish-formed to the completed part 336 between the lower curl block 274 and the curl punch 280. Part 336 is formed about the floating mandrel 284 so that its interior dimension can be carefully controlled thereby. Its exterior dimension is controlled by block 274 and punch 280. If such careful control of the interior dimensions of parts being formed is not essential, floating mandrel 284 can be omitted from the apparatus.

After finish-forming, part 336 can be ejected from the die set as the next secondarily formed blank 334 is urged over the floating mandrel 284 of the third die section 270. Alternatively, the third die section 270 can be made long enough to accommodate two or more parts therein, in which case the parts 336 will be retained in die section 270 and struck again during one or more successive strokes of the press. This same feature of independent lengths of the first, second and third die sections accounts for a great degree of flexibility in the length of the parts to be formed by the instant method and apparatus.

It is important to note that such parameters as the configuration to which first die section 120 forms edge portions 322, 324 of the primarily formed blank 326 and score angle 340 (see FIG. 7) will vary, depending upon the thickness of the coil stock 47 being formed. Such parameters will affect the configuration of the seams 342 which exist between the longitudinal edges 344, 346 of edge portions 322, 324, respectively, in finished parts 336.

It must further be understood that the disclosed method and apparatus are quite useful for forming parts other than right circular cylinders such as the one illustrated. For example, other right cylindrical parts can be formed. It must further be understood that such parts can either be "open" or "closed", i.e., the longitudinal edges 344, 346 of the finished part may abut one another or may be separated by a predetermined distance as desired, although a significant feature of the instant method and apparatus is that they are capable of forming very tight butt joints between edges 344, 346 of the finished part.

I claim:

1. The method of forming a generally cylindrical part from a strip of stock comprising the steps of scoring the strip of stock along a score line having side walls disposed at predetermined angles with respect to one another, the score line being formed a distance from the free end of the strip, and breaking the stock along the score line to form a generally flat rectangular blank of material having two opposite edges at predetermined angles with respect to one another, transferring the blank generally horizontally in a first direction from the scoring step to a first die section, primarily forming the blank by bending two opposite longitudinal edge portions of the blank to predetermined configurations with respect to the remainder of the blank in the first die section, transferring the primarily formed blank by moving the primarily formed blank generally horizontally in a second direction generally perpendicular to the first to a second die section, secondarily forming the blank in the second die section about an axis parallel to the two longitudinal edge portions with the longitudinal edge portions turned inwardly at opposite edges of the secondarily formed blank, transferring the secondarily formed blank by moving it in the second direction to a third die section, and forming the blank into the part in the third die section by curling the blank so that the two longitudinal edges are adjacent one another, each of the transferring steps including engaging of the first-mentioned blank by the next successive blank through the successive forming and curling steps, the next successive blank pushing the first-mentioned blank through the successive transfer steps, the step of transferring the secondarily formed blank into the third die section, further comprising the step of lifting the first-mentioned blank after the secondary forming step and prior to engagement by the next successive blank to transfer the secondarily formed blank to the third die section.

2. For use with a punch press including a pair of spaced-apart surfaces for mounting a plurality of die sections thereon and means for moving one of the surfaces toward and away from the other during each press stroke, apparatus for forming a generally cylindrical part from a flat, generally rectangular stock blank comprising a first die section for primarily forming the blank to bend two lateral edge portions thereof to a predetermined configuration with respect to the remaining portion of the blank, at least one die block of the first section being mounted from each of the surfaces, a second die section for secondarily forming the primarily formed blank, the secondarily formed blank having a generally oval transverse section with the two lateral edges in spaced-apart relation adjacent one another defining a longitudinally extending slot therebetween, at least one die block of the second section being mounted from each of the surfaces, a third die section for curl-forming the part from the secondarily formed blank, at least one die block of the third section being mounted from each of the surfaces, and means for transferring the partially formed blank through the successive die sections, the third die section including a floating mandrel for controlling an interior dimension of the part during curl-forming, the floating mandrel including an outer surface sized to control the interior dimension, and means for supporting the floating mandrel in the third die section to permit the secondarily formed blank to be transferred from the second die section to a position in engagement with the floating mandrel prior to curl-forming, the floating mandrel having a bore extending therethrough parallel with the floating mandrel axis, and the floating mandrel support means including a flexible cable which extends through the bore, the flexible cable having first and second ends, the ends being provided with cable snubbers and a spring for absorbing shock during curl-forming by the third die section, the spring being mounted adjacent one of the cable ends, the cable being supported by the snubbers and spring from selected ones of the die sections.

3. The apparatus of claim 2 wherein the floating mandrel is horizontally disposed between two die blocks of the third die section.

4. For use with a punch press including a pair of spaced-apart surfaces for mounting a plurality of die sections thereon and means for moving one of the surfaces toward and away from the other during each press stroke, apparatus for forming a generally cylindrical part from generally flat strip stock including a scoring punch and anvil for scoring the strip stock a distance from its free end substantially equal to the perimeter of the part, the scoring punch and anvil providing on the strip stock a score line, two adjacent walls of the score line having a predetermined angle therebetween, means for breaking the free end from the stock along the score line to provide a blank having two lateral edges with a predetermined angle therebetween, a first die section for primarily forming the blank to bend two lateral edge portions thereof adjacent the scored edges to a predetermined configuration with respect to the remaining portion of the blank, at least one die block of the first section being mounted from each of the surfaces, a second die section for secondarily forming the primarily formed blank, the secondarily formed blank having a generally U-shaped transverse section with the two lateral edges in spaced-apart relation adjacent one another defining a longitudinally extending slot therebetween, at least one die block of the second section being mounted from each of the surfaces, a third die section for curl-forming the part from the secondarily formed blank, at least one die block of the third section being mounted from each of the surfaces, and means for transferring the partially formed blank through the successive die sections, the means for transferring the secondarily formed blank from the second die section to the third comprising means for moving the secondarily formed blank vertically so that it may be engaged by the next successive blank to be moved into a position for secondary forming, the next successive blank moving the first-mentioned blank into a position for curl-forming.

5. The apparatus of claim 4 wherein the means for moving the secondarily formed blank vertically comprises a plurality of stripper fingers spring-urged into engagement with the longitudinal edges of the secondarily formed blank to move the blank vertically.

6. For use with a punch press including a pair of spaced-apart surfaces for mounting a plurality of die sections thereon and means for moving one of the surfaces toward and away from the other during each press stroke, apparatus for forming a generally cylindrical part from a flat, generally rectangular stock blank comprising a first die section for primarily forming the blank to bend two lateral edge portions thereof to a predetermined configuration with respect to the remaining portion of the blank, at least one die block of the first section being mounted from each of the surfaces, a second die section for secondarily forming the primarily formed blank, the secondarily formed blank having a generally oval transverse section with the two lateral edges in spaced-apart relation adjacent one another defining a longitudinally extending slot therebetween, at least one die block of the second section being mounted from each of the surfaces, a third die section for curl-forming the part from the secondarily formed blank, at least one die block of the third section being mounted from each of the surfaces, and means for transferring the partially formed blank through the successive die sections, selected dies of the first, second and third die sections being axially aligned with one another, the means for transferring the partially formed blank through the successive die sections comprising a feed for moving the primarily formed blank parallel to the alignment axis of the first, second and third die sections, axial movement of the primarily formed blank causing the preceding secondarily formed blank to move axially into the third die section, the third die section including a floating mandrel for controlling an interior dimension of the part during curl-forming, the floating mandrel including an outer surface sized to control the interior dimension, means defining a bore which extends therethrough parallel to the alignment axis of the first, second and third die sections, and the first and second die sections including bores coaxial with the floating mandrel bore, a flexible cable having first and second ends, the cable being threaded through the coaxial bores in the first and second die sections and the floating mandrel, the ends of the cable extending from the first die section and the floating mandrel and being provided with cable snubbers and at least one of the ends further being provided with a spring for absorbing shock during curl-forming about the floating mandrel in the third die section.

7. For use with a punch press including a pair of spaced-apart die shoes defining facing surfaces and means for moving one of the surfaces toward and away from the other during each stroke of the punch press, apparatus for forming a generally cylindrical part from a flat, generally rectangular blank of material comprising at least one die section for partially forming the blank to have a generally U-shaped transverse section with two opposite lateral edge portions of the blank in spaced-apart relation, a die section for curl-forming the partially formed blank into the part, the die sections being axially aligned with one another, means for axially transferring the partially formed blank from the first-mentioned die section to the last-mentioned die section, the last-mentioned die section including a floating mandrel which extends axially of the die sections, the floating mandrel including an outer surface for controlling an interior dimension of the curl-formed part and means defining a bore extending through the floating mandrel parallel to the alignment axis of the die sections, the first-mentioned die section including means defining a bore through a die block thereof, which bore is coaxial with the floating mandrel bore, a flexible cable having two ends, the cable extending through the coaxial bores, the ends of the cable being equipped with cable snubbers for supporting the floating mandrel from the first-mentioned die section.

8. The invention of claim 7 wherein at least one of the cable ends includes a spring for maintaining tension of the cable and for absorbing shock due to the transfer of the partially formed blank from the first-mentioned die section onto the floating mandrel and subsequent forming of the blank in the last-mentioned die section.

* * * * *

UNITED STATES PATENT OFFICE

CERTIFICATE OF CORRECTION

Patent No. 4,083,221 Dated April 11, 1978

Inventor(s) Robert Lee Whitted

It is certified that error appears in the above-identified patent and that said Letters Patent are hereby corrected as shown below:

Column 12, line 37 (Claim 8), change "of" to --on--.

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*